US007730584B2

(12) United States Patent
Duffy

(10) Patent No.: US 7,730,584 B2
(45) Date of Patent: Jun. 8, 2010

(54) SINGLE PIVOT HINGE WITH INTEGRAL COIL SPRING ASSIST

(75) Inventor: Michael J. Duffy, Midland (CA)

(73) Assignee: M & C Corporation, Sterling Heights, MI (US)

( * ) Notice: Subject to any disclaimer, the term of this patent is extended or adjusted under 35 U.S.C. 154(b) by 15 days.

(21) Appl. No.: 11/446,857

(22) Filed: Jun. 5, 2006

(65) Prior Publication Data

US 2006/0225247 A1 Oct. 12, 2006

Related U.S. Application Data

(62) Division of application No. 10/774,807, filed on Feb. 9, 2004, now abandoned.

(51) Int. Cl.
*E05F 1/08* (2006.01)

(52) U.S. Cl. ..... 16/304; 16/306; 16/295; 16/366; 16/370

(58) Field of Classification Search ..... 16/286, 16/289–292, 294, 304, 306, 302, 305, 307, 16/308, 295, 366, 370, 368, 369
See application file for complete search history.

(56) References Cited

U.S. PATENT DOCUMENTS

| | | | | |
|---|---|---|---|---|
| 1,145,731 | A | 7/1915 | Wirth | |
| 1,636,386 | A | 7/1927 | Oberreich | |
| 2,235,984 | A | 3/1941 | Devereaux | |
| 2,479,437 | A * | 8/1949 | Vigmostad et al. | 16/289 |
| 2,482,883 | A | 9/1949 | Thomas | |
| 2,720,676 | A * | 10/1955 | Vigmostad | 16/289 |
| 2,771,629 | A * | 11/1956 | Gessler | 16/289 |
| 2,822,567 | A * | 2/1958 | McCreary | 16/289 |
| 2,840,847 | A * | 7/1958 | Danser | 16/288 |
| 2,880,453 | A * | 4/1959 | Gessler | 16/289 |
| 3,024,488 | A | 3/1962 | Germann | |
| 3,351,975 | A * | 11/1967 | Goto | 16/288 |

(Continued)

FOREIGN PATENT DOCUMENTS

| | | |
|---|---|---|
| GB | 2080409 A | 2/1982 |

(Continued)

OTHER PUBLICATIONS

1997 Service Manual; GMP/97-WPB-1; 4 pages of Book 1; North American Operations, General Motors Corp.

*Primary Examiner*—Victor Batson
*Assistant Examiner*—Jeffrey O'Brien
(74) *Attorney, Agent, or Firm*—Brooks Kushman P.C.

(57) ABSTRACT

A vehicle closure hinge includes a mount having a pivot axis flange, a pivot link, a pivot coupling the pivot link to the pivot axis flange and a spring formed by a laterally coiled strand extending from a first coil end to a second coil end in a direction substantially perpendicular to the plane of displacement about the pivot axis. The coil size, the strand size and the number of coils can be varied as desired to vary the spring biasing force exerted against the vehicle closure without varying other components of the hinge. The hinge parts may be designed with various configurations including simple pivoting links or a four bar linkage. A strand end of the coil spring extends along the direction of the coil to a position at a first coil end to maintain biasing force near the plane of displacement about the pivot axis.

9 Claims, 7 Drawing Sheets

U.S. PATENT DOCUMENTS 3,810,275 A 5/1974 Smith
3,955,865 A * 5/1976 Wilson ..... 126/191
4,291,501 A 9/1981 Steinberg et al.
4,377,019 A 3/1983 Takahashi
4,458,379 A 7/1984 Shelton
4,524,438 A 6/1985 Einhaus
4,819,981 A 4/1989 Moe et al.
5,235,725 A 8/1993 Rees
5,243,738 A 9/1993 Kiefer
5,320,333 A 6/1994 Koch
5,419,012 A 5/1995 Lewis
5,465,862 A * 11/1995 Devlin ..... 220/830
5,557,829 A 9/1996 Schoen et al.
5,664,289 A * 9/1997 Wolda et al. ..... 16/298
5,894,633 A 4/1999 Kaneko
6,453,510 B1 * 9/2002 Cummins et al. ..... 16/343
6,487,754 B1 12/2002 Keen
6,553,623 B2 4/2003 Long
6,892,423 B2 * 5/2005 Cheal et al. ..... 16/289
2002/0166208 A1 * 11/2002 Kondo et al. ..... 16/289

FOREIGN PATENT DOCUMENTS

JP 56-34578 A 4/1981

* cited by examiner

SINGLE PIVOT HINGE WITH INTEGRAL COIL SPRING ASSIST

CROSS-REFERENCE TO RELATED APPLICATIONS

This application is a division of U.S. application Ser. No. 10/774,807 filed Feb. 9, 2004 now abandoned.

BACKGROUND OF THE INVENTION

1. Field of the Invention

The present invention relates to a motor vehicle closure hinge having a pivot axis with spring biasing provided by a laterally coiled spring to prop the closure.

2. Background Art

Many previously known vehicle closure hinges such as those used for engine compartment hoods and trunk lids often include spring biasing to assist displacement of the heavy panel which is displaced about a pivot axis at one end of the panel. However, a spring biasing assist force sufficient to maintain the closure in a fully open position is often provided by additional structure such as a prop rod, gas struts or the like that resists closure of the closure panel by the weight of the panel acting in a moment of arm about the pivot axis or force transfer through a linkage.

One method to provide the spring biasing has been to use the torsion rods that can be routed across the car. However, while such spring biasing can be strong enough to resist closure, since the entire length of the torsion rod provides spring biasing force, the elongated torsion rods can obstruct and form a substantial impediment to the access through the opening or within the compartment covered by the closure panel. Other improvements to spring design, such as gas powered struts or powerful springs often require multiple installation steps since the spring biasing force unit must be separately installed to assist a conventional hinge structure. Such improvements substantially increase the difficulty of production, rendering the use of such components prohibitively expensive because they add production steps as well as additional pieces and mass to the vehicle. In the case of a gas strut power source, in a closed position the line up force in the strut is directed to the hinge pivot, thus forcing the pivot to endure high loading that shortens useful life of the original installation. Also, the life of a gas strut is both time-dependent and cycle-dependent, making it much less durable than a steel spring.

Moreover, once the design and the spring force has been determined for a particular application, the hinge designs may not be readily incorporated into other vehicles having differently sized, weighted or balanced mass or center of gravity than the installation for which it was designed. Rather, the alternative closures need specially designed linkage and/or biasing structures for each particular closure panel type, thereby substantially multiplying the number of assemblies and production pieces that must be made and inventoried by automobile manufacturers and dealers trying in order to accommodate production and repair of the entire product lines of vehicles.

A previously known attempt to address the problems discussed above involves the use of a single pivot arm as part of a four bar link assembly and integral radially wound clock spring. However, while the clock spring may integrate spring biasing force to a hinge mechanism, such springs and require an extremely large envelope both vertically as well as fore-and-aft accommodate the four bar linkage. As a result, these known mechanisms are suitable only for large vehicles, such as trucks. Moreover, alternative designs have been complex, requiring numerous parts and assembly operations, the addition of parts rendering the hinge relatively heavy, and thus have not found favor in many production applications due to the large expense compared to more conventional systems.

SUMMARY OF THE INVENTION

The present invention overcomes the above mentioned disadvantages by providing a single pivot closure hinge design that is preassembled as an integral unit for shipping and installation in one piece. Linkage geometry can be designed to accommodate packaging restraints such as available room in the hinge region, and differences in the mass or center of gravity of closure panels can be accommodated without substantially changing the physical link structure of the integral package components. More particularly, the package includes a laterally coiled spring whose coil diameter, wire diameter and number of laterally aligned coils can be changed to modify closure panel performance. In addition, the coil can be mounted about the pivot axis of the hinge, or eccentrically from the pivot axis when space limitations at the pivot envelope demand or when adjacent areas permit a four bar linkage to fit in the vehicle. In addition, the integral packaging of the laterally coiled spring may be applied to various linkage arrangements.

In a preferred embodiment, the laterally coiled spring is housed in a bracket for pivotally mounting a goose-neck bar about a pivot axis. The coil spring can be wrapped around the pivot axis or as shown in a modified version, mounted eccentrically to the pivot axis of the goose-neck bar through a lever assembly. In addition, the eccentrically mounted coil spring can include radially extended end portions that form a four bar linkage with a mount including a pivot axis flange and a pivot lever pivotally coupled to the mount. Furthermore, the strand ends may be coupled to the linkage at one end of the coil, so that the coil ends are arranged substantially in a plane of displacement of the linkage.

Accordingly, the present invention provides substantial cost savings since the integral hinge unit requires substantially fewer labor steps and part installation steps than previously known gas strut or clock spring assemblies. Moreover, the reliability of springs, such as those made of steel, is improved since they can endure a wide range of temperatures and ambient conditions that may have previously affected gas struts and previously known hinge constructions. Moreover, the present invention reduces obstruction at the openings or within the compartments covered by the vehicle closure panels. Moreover, a predetermined hinge structure may be more readily modified for different closure panels having different mass or center of gravity requirements, in large part by adjusting the connection points of the hinge and the size of the coils, the size of the spring strand diameter and the number of coils in the spring. Moreover, the present invention may reduce hinge pivot loading.

BRIEF DESCRIPTION OF THE DRAWINGS

The present invention will be more clearly understood by reference to the following detailed description of a preferred embodiment when read in conjunction with the accompanying drawing, in which like reference characters refer to like parts throughout the views, and in which.

DETAILED DESCRIPTION OF THE PREFERRED EMBODIMENTS

Figure 1:
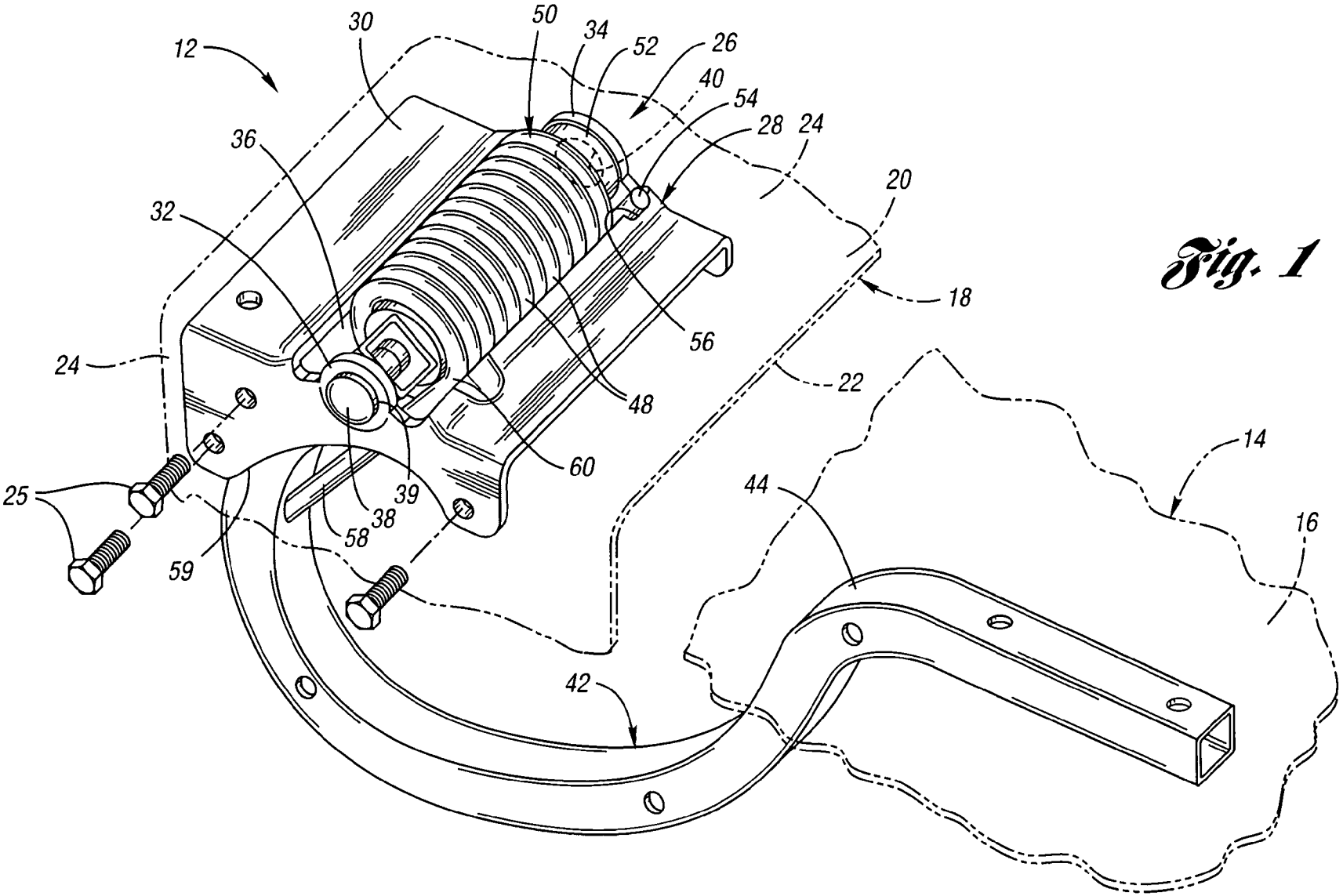
FIG. 1 is an enlarged perspective view of a vehicle body with a closure having portions removed for the sake of clarity and showing the hinge, constructed according to the present invention, in a closed position.

Referring first to FIG. 1, a vehicle body 12 is shown including a vehicle closure panel 14, for example, a trunk lid 16, styled to fit over an opening 18 providing access to compartment 20, for example, trunk cavity 22. The panel 16 is pivotally coupled to the body structure 24 at an edge of the opening 22 by a hinge mechanism 26 comprising a pair of hinge assemblies 28 (one shown) at right and left hand portions of the panel 16.

The hinge assembly 28 comprises a mount bracket 30 to be secured to the body structure 24 for example, by bolts 25 and correspondingly threaded nuts. The bracket 30 includes pivot axis flanges 32 and 34 spaced apart along a pivot axis defined by openings in the flanges 32 and 34, preferably at opposite ends of the central opening 36. A pivot pin 38 extends across the opening 36 through the pin receiving openings 39 and 40 in each of the flanges 32 and 34. A pivot lever 42, preferably in the form of a goose-neck bar 44, includes openings receiving the pivot pin 38 at one end of the bar 44. Preferably, the bar is fabricated in the form of a rectangular tube.

The pivot pin 38 is also received through the coils 48 of a laterally coiled spring 50 carried within the opening 36 of the bracket 30. A core 52 made of bushing material that does not cause noise when in contact with metal, for example nylon, supports the coiled spring 50 coaxially over the pivot pin 38 and adjacent to the bar 44. One strand end 54 is retained in a notch 56 adjacent the opening 36 in the bracket 28. The other end 58 of the strand 60 includes an elongated portion captured in an opening 59 (FIG. 2) in the bar 44. As a result, bar 44 is spring biased by the coil spring 50 with respect to the bracket 30 mounted to the body structure 24.

Figure 2:
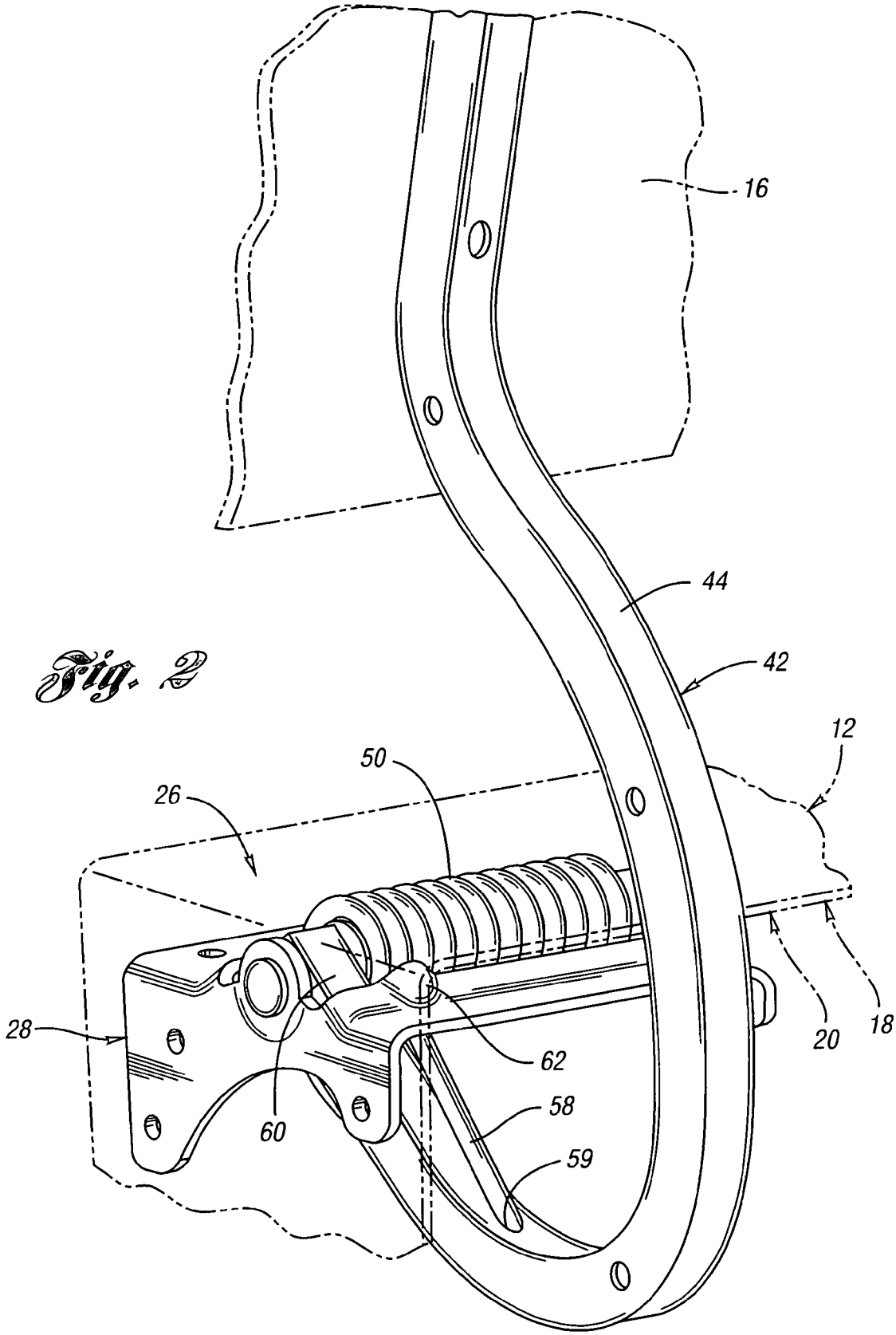
FIG. 2 is a perspective view of the arrangement in FIG. 1 showing the vehicle body closure and hinge at an open position.

As best shown in FIG. 2, the coil spring 50 biases the pivot lever 42 to a raised or open position in which the panel 16 is spaced apart from the opening 18 of the vehicle body 12. In the illustrated embodiment, a control channel 62 in the bracket 30 receives the elongated terminal portion 58 of the strand 60 so as to position the goose-neck bar 44 in a non-interfering position with respect to the opening 18 over the compartment 20. Nevertheless, when the lid 16 is closed, so that the panel 16 covers the opening 18 in the body 12, and is retained in the position shown in FIG. 1, by a latch at the latch end of the lid in a well-known manner (not shown), the goose-neck bar 44 is retained in the position shown in FIG. 1.

Figure 3:
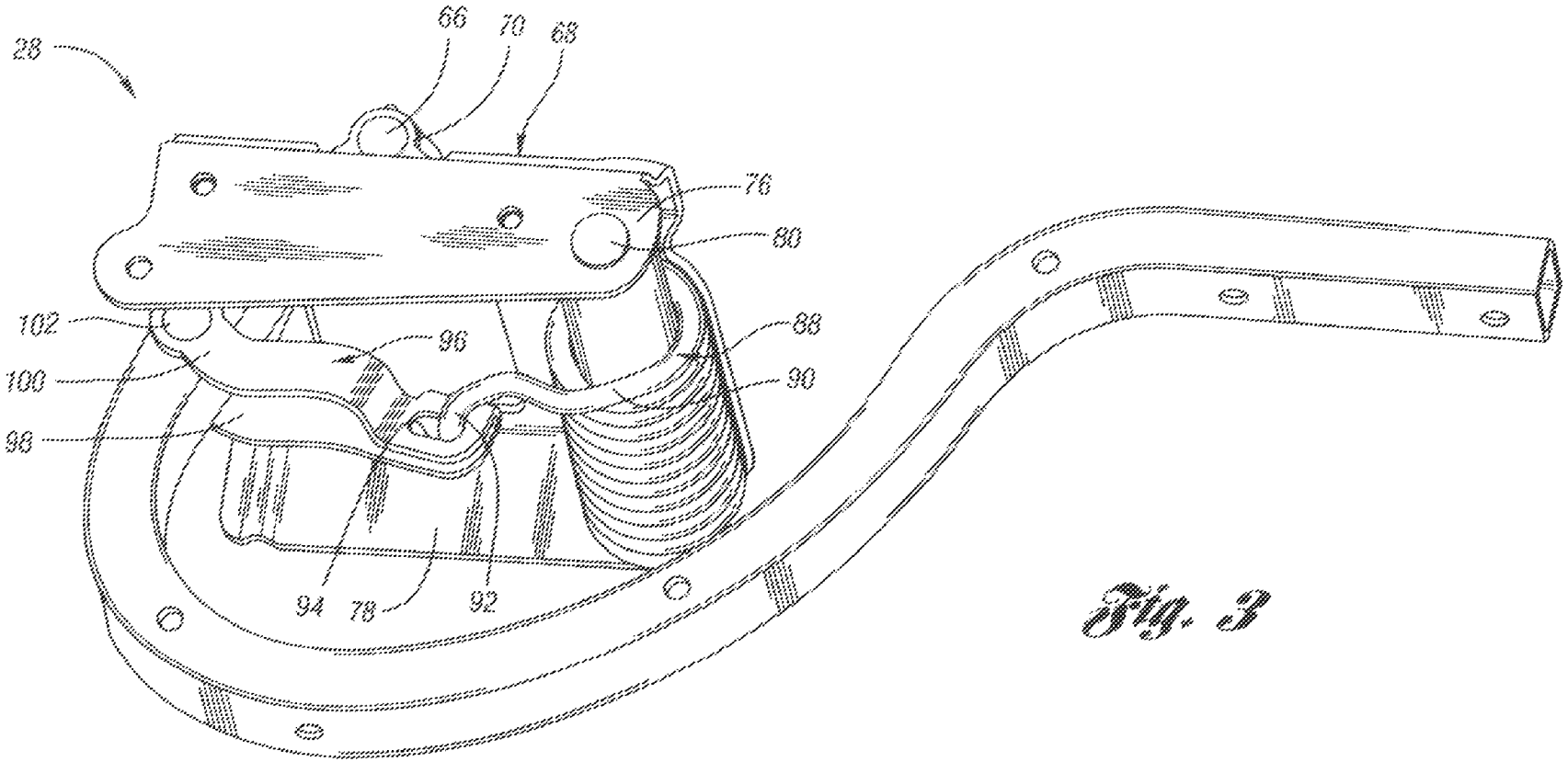
FIG. 3 is a perspective view of a modified vehicle closure hinge with a vehicle closure panel in a closed position.
Figure 4:
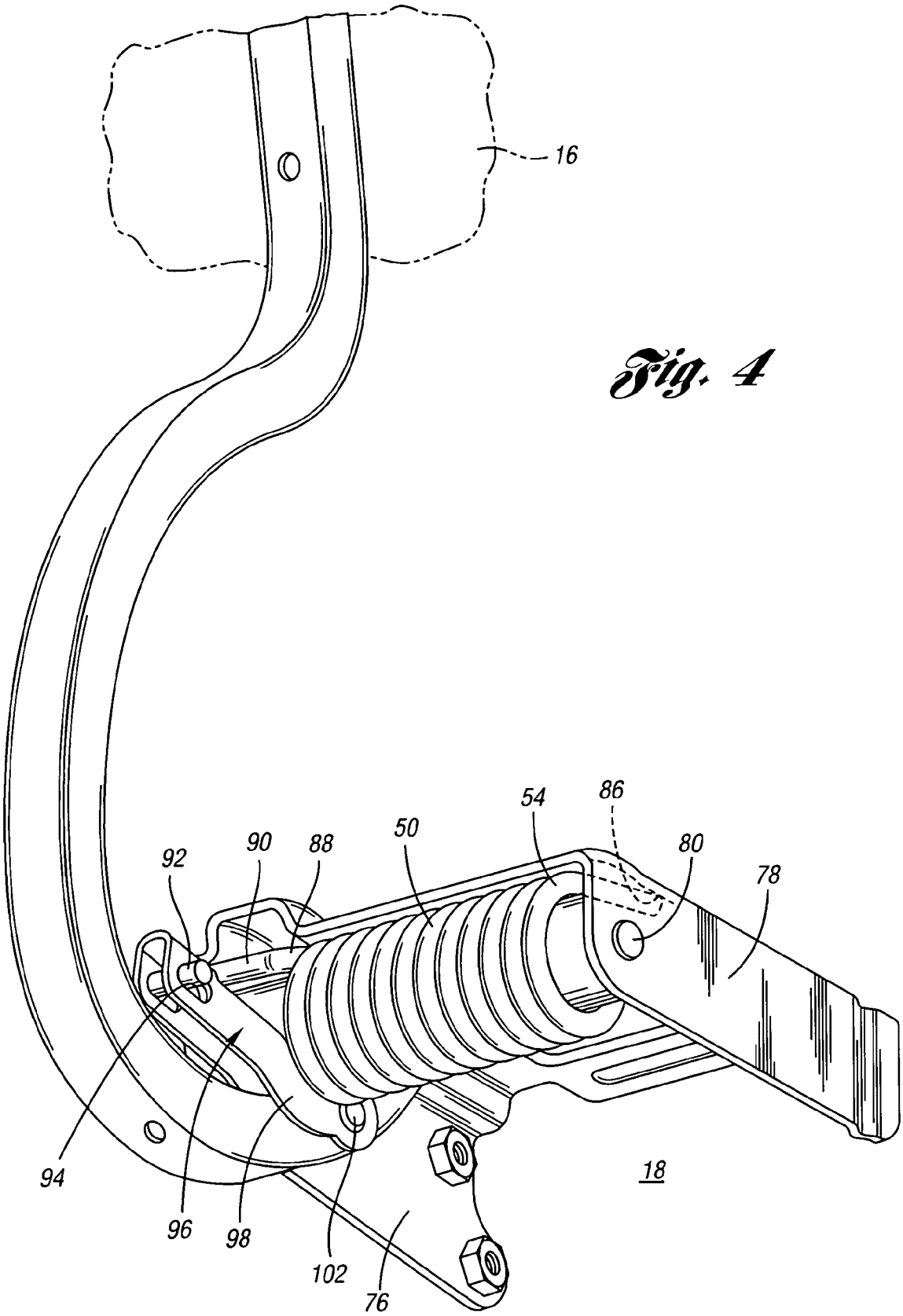
FIG. 4 is an opposite perspective view of the hinge mechanism shown in FIG. 3, but showing the hinge in the opening position.
Figure 5:
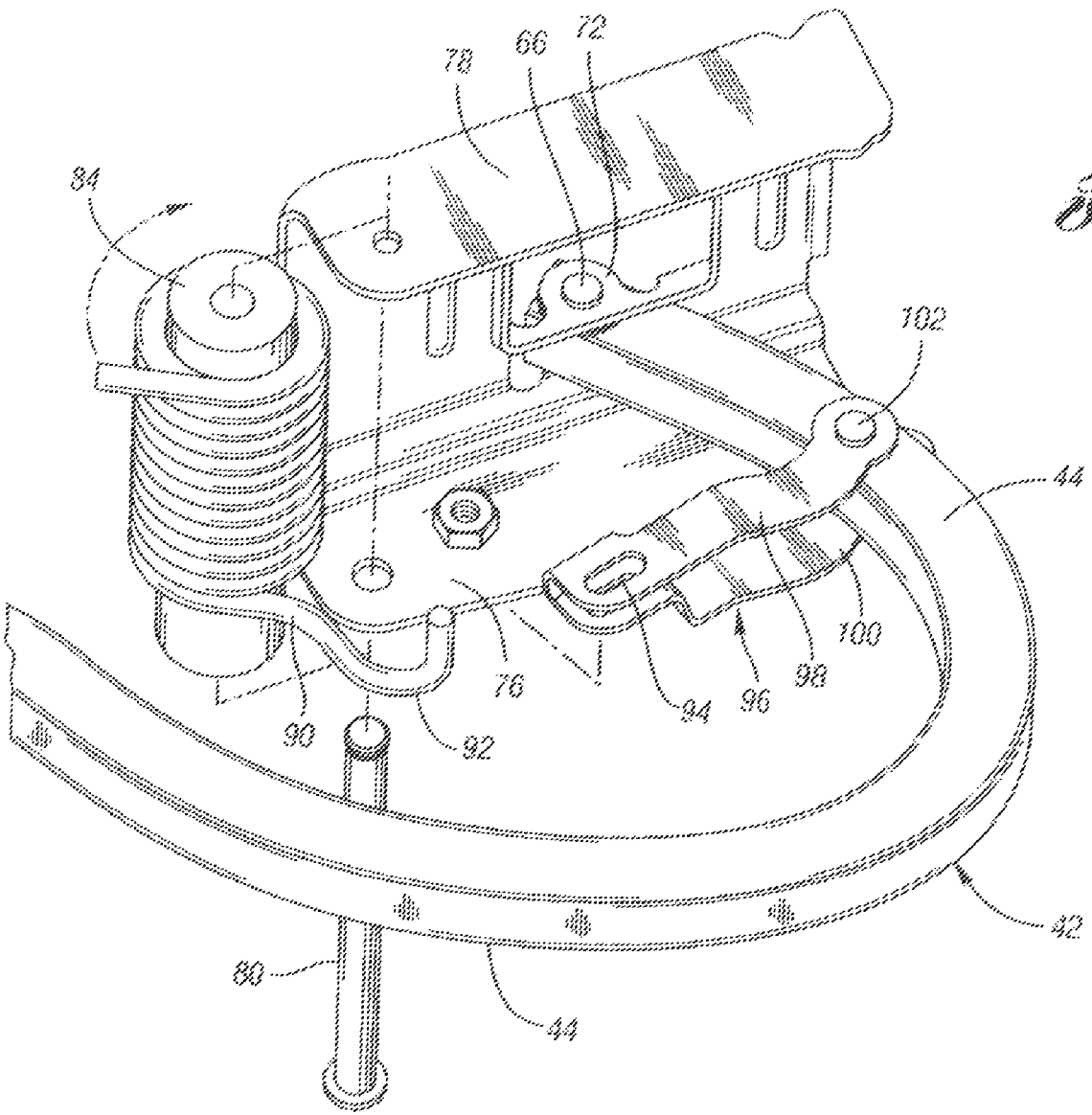
FIG. 5 is an exploded perspective view of a portion of the device shown in FIGS. 3 and 4.

Referring now to FIGS. 3-5, a mount 28 in a form of a bracket 68 includes pivot axis flanges 70 (FIGS. 3) and 72 (FIG. 5) in spaced apart positions. Each of the pivot axis flanges 70 and 72 (FIG. 5) have openings adapted to receive pivot pin 66. As in the previous embodiment, a pivot lever 42, preferably in the form of a goose-neck bar 44, includes openings adapted to receive the pivot pin 66 in the end of the bar 44 positioned between the pivot axis flanges 70 and 72.

The bracket 68 also includes spring support flanges 76 and 78 having openings adapted in receive a mounting pin 80. The mounting pin 80 is received in the central openings of a spring bushing 84. The coil spring 50 includes a bracket engaging end 54 received in a retention groove 86 (FIG. 4) in the bracket 68. The other end 88 of the spring strand includes an elongated portion 90 and a terminal hook portion 92. The hook portion 92 is received in the spring retainer openings 94 in a pivot link 96. The other end of the link 96 includes the spaced pivot flanges 98 and 100 (FIG. 3) that receive a pivot pin 102 extending through opening in the goose bar 44.

As best shown in FIG. 4, the spring biases the link 96 rearwardly, thereby pulling the lever 96 to raise bar 44 with the 4-bar linkage formed between the pivot points 66, 80, 94 and 102 as best viewed in FIG. 3, to displace goose-neck bar 44 toward an extended position that positions the panel 16 to its open position spaced apart from the trunk opening 18. When the trunk lid 16 coupled to the bar 44 is pivoted to its closed position as shown in FIG. 3, the force of the coiled spring 50 is resisted by link 96 and bar 44 at the pivot pin 102 rather than directly on the hinge axis pivot pin 66 extending through the pivot axis flanges 70 and 72. Nevertheless, like the embodiment shown in FIGS. 1 and 2, the hinge assembly including a biasing spring and linkage is preassembled for delivery to, and installation as one piece in, the vehicle body 12.

Figure 6:
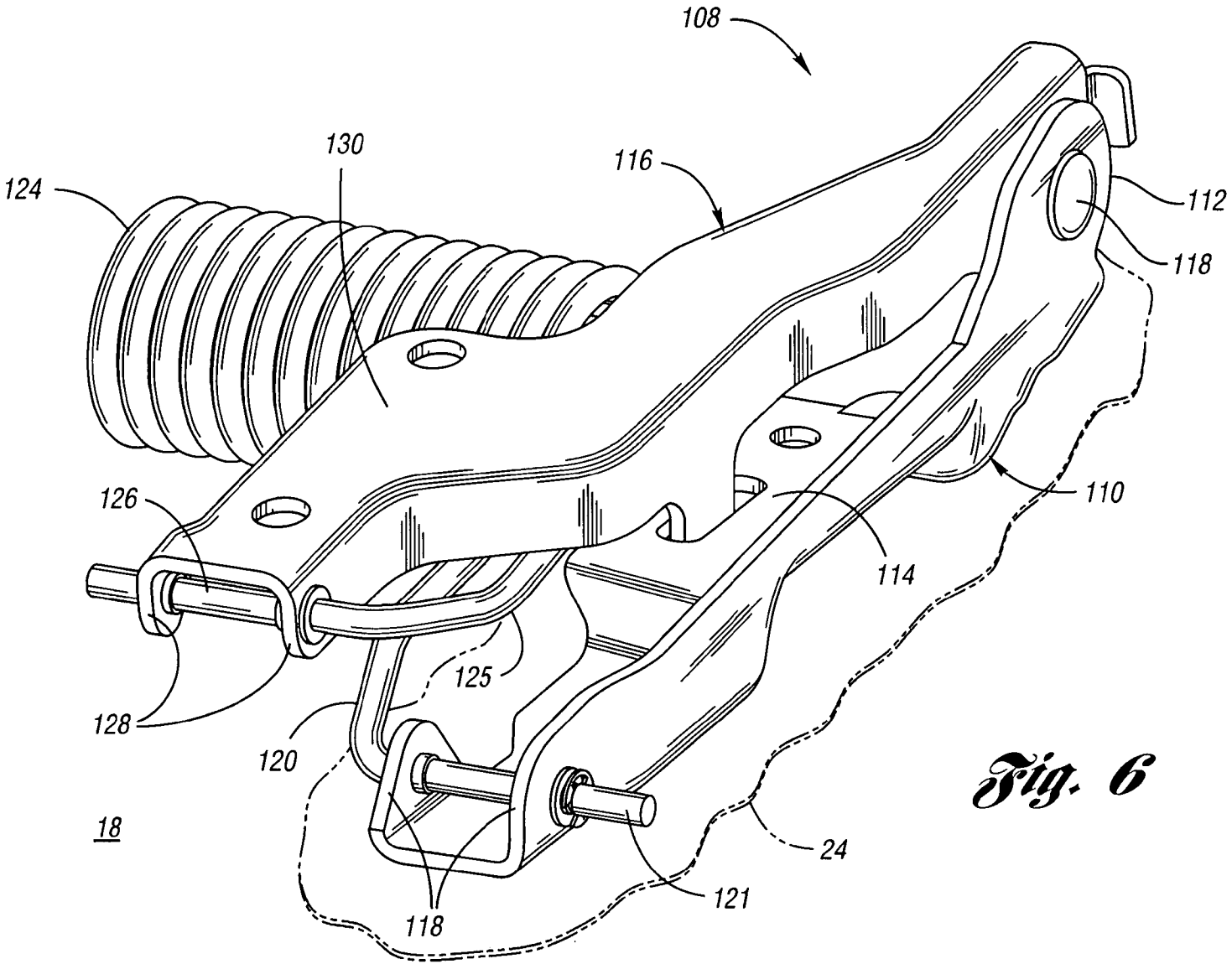
FIG. 6 is a perspective view of a vehicle closure hinge incorporating a four bar linkage and showing the hinge in its closed position.
Figure 7:
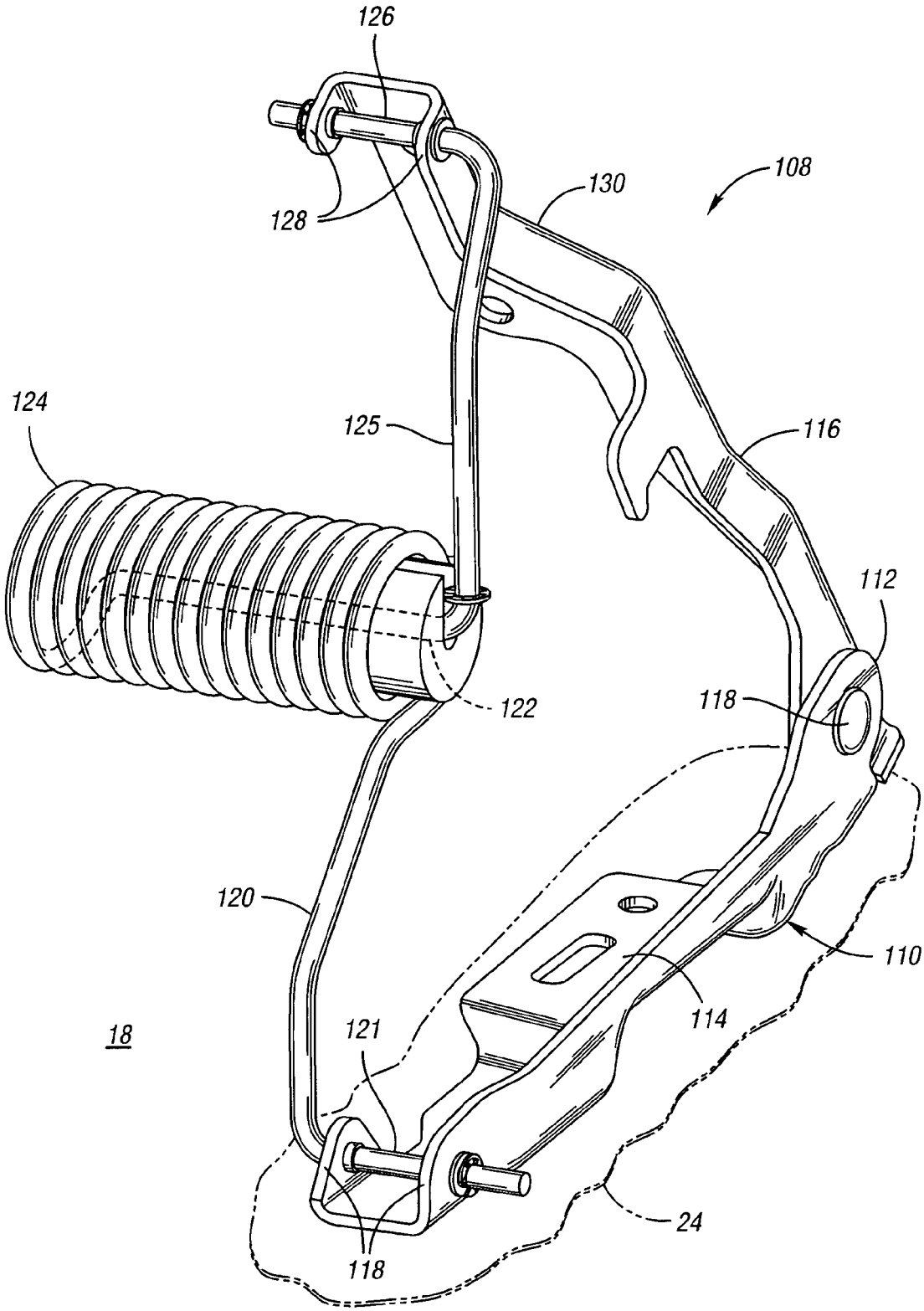
FIG. 7 is a perspective view of the hinge shown in FIG. 6, but showing the hinge in its open position.

Referring now to FIGS. 6 and 7, a hinge assembly 108 includes a mount 110 includes a pivot axis flange 112 adapted to be secured to a peripheral structure 24, for example, by a mounting flange 114. A pivot link 116 is pivotally coupled to the pivot axis flange 112 by a pivot pin 118.

The hinge assembly 108 also includes a laterally coiled spring 50. However, one end 120 of the coiled strand includes an elongated terminal portion that proceeds generally radially outwardly from the center of the coil. A terminal end 121 is bent for engagement in pivot flanges 118 carried by the mount 110. The other end 124 of the coiled strand includes a return portion 122 that extends along a longitudinal direction of the coil, preferably through the interior of the coil, to a position at or near the coil end 120. The longitudinally extended portion 122 is then extended in a direction generally radially away from the center of the coil along a portion 125 toward a retaining end 126. The end 126 is pivotally engaged in pivot axis flanges 128 carried at the end of the pivot link 116. The terminal portions 125 and 120 of the spring 50 join with the pivot link 116 and the mount 110 to form a four bar hinge.

Accordingly, a lid 16 may be mounted to pivot link 116, for example at mounting flange 130, and spring biased upwardly to an open position as shown in FIG. 7. When the lid 16 is closed over the vehicle opening 18, and latched in a well-known manner, the hinge mechanism is positioned as shown in FIG. 6, and the forces of the coil spring 50 are resisted at the pivot flanges 118 and 128 at a position spaced apart from the pivot pin 118.

Having thus described preferred embodiments of the present invention, many modifications will become apparent to those skilled in the art to which it pertains without departing from the scope and spirit of the present invention as defined in the appended claims.

What is claimed is:

1. A vehicle closure hinge comprising:

a mount including a pivot axis flange locating a pivot axis, a first spring support flange and a second spring support flange spaced from said first spring support flange;

a pivot lever coupled to the vehicle closure;

a pivot coupling said pivot lever to said pivot axis flange;

a torsion spring comprising a laterally coiled strand extending from a first coil end to a second coil end along a coil axis spaced from the pivot axis, said coil ends and said coil axis housed intermediate said first and second spring support flanges throughout hinge displacement, said strand having a first strand end extending from said first coil end, and a second strand end extending from said second coil end and coupled to said mount;

wherein said pivot lever is a gooseneck bar;

a link pivotally coupled to and carried by said pivot lever at a point spaced from said pivot coupling said pivot lever to said pivot axis flange;

wherein said first strand end is pivotally coupled to said link; and wherein said link includes a second pivot coupling said link to said pivot lever thereby defining a four bar linkage controlling the biasing of said pivot lever to open the vehicle closure.

2. The invention as defined in claim 1 wherein said coil axis is parallel to said pivot axis.

3. The invention as defined in claim 1 wherein at least one of said first and second spring support flanges has an opening that receives a support pin.

4. The invention as defined in claim 3 and further comprising a spring bushing having a central opening receiving said pin.

5. The invention as defined in claim 1 wherein said first strand end comprises a hook.

6. The invention as defined in claim 5 wherein said hook engages said link.

7. The invention as defined in claim 6 wherein said link includes spaced pivot flanges.

8. The invention as defined in claim 7 wherein said pivot flanges and said pivot lever receive a pivot pin.

9. The invention as defined in claim 1 wherein said torsion spring's biasing pulls said link.

* * * * *